United States Patent [19]

Hetzelt et al.

[11] 4,452,467

[45] Jun. 5, 1984

[54] CROSS COUNTRY SKI

[75] Inventors: Stephan Hetzelt, Brunnthal; Oswald Pichler, Hohenbrunn-Riemerling, both of Fed. Rep. of Germany

[73] Assignee: TRAK Sportartikel GmbH, Fed. Rep. of Germany

[21] Appl. No.: 397,887

[22] Filed: Jul. 13, 1982

[30] Foreign Application Priority Data

Jul. 15, 1981 [DE] Fed. Rep. of Germany ..... 3128009

[51] Int. Cl.[3] ..... A63C 9/18

[52] U.S. Cl. ..... 280/615

[58] Field of Search ..... 280/607, 613, 614, 615, 280/635

[56] References Cited

U.S. PATENT DOCUMENTS 2,172,669 9/1939 Taft ..... 280/614
4,108,467 8/1978 Kreyenbuhl ..... 280/615

FOREIGN PATENT DOCUMENTS 2754005 6/1979 Fed. Rep. of Germany .
136335 7/1979 Fed. Rep. of Germany .
67919 4/1914 Switzerland ..... 280/615
283869 10/1970 U.S.S.R. ..... 280/615

*Primary Examiner*—Joseph F. Peters, Jr.
*Assistant Examiner*—Michael Mar
*Attorney, Agent, or Firm*—Richard P. Crowley

[57] ABSTRACT

The invention concerns a ski particularly a touring and/or cross-country ski, with a binding (10) for holding an anterior tongue-shaped extension of the sole of a ski shoe. The binding (10) is formed by a recess (16) provided in the ski body (12) extending in the longitudinal direction of the ski, with a sole latching apparatus (abutments 18, 18'; latching device 20 or locking device 20') for fixing the sole extension and thus the ski shoe in a positively locked and friction-locked manner. The ski binding (10) is thus provided in the ski body (12) in integrated manner, so that no parts protrude above the ski deck area (14). In this way a subsequent mounting of the ski binding (10) is no longer necessary. In addition, the skis can be shipped with the ski binding (10) mounted for conventional skis without binding, tightly packed against each other. Finally, there is no additional friction caused by the ski binding during the cross-country run in somewhat deeper snow.

18 Claims, 8 Drawing Figures

CROSS COUNTRY SKI

THE INVENTION

The invention concerns a touring and/or cross-country ski with a binding for holding an anterior tongue-shaped extension of the sole of a ski shoe in positively and frictionally locking manner.

BACKGROUND OF THE INVENTION

Conventional cross-country ski bindings consist of jaw designs where several pins protrude upward which engage into the holes of a tongue-shaped extension of the outsole of a ski shoe. The tongue-shaped sole extension is held by an elastic bow so that the shoe is attached to the ski in this manner. The handling of such bindings requires quite considerable effort. Above all it is difficult when putting on the skis, to get the holes in the sole extension aligned with the pins of the binding which protrude upward.

In addition, with this conventional design it is awkward if the jaws of the ski binding protrude laterally beyond the ski and thus cause more friction in somewhat deeper snow. In addition, with the known designs the ski bindings must always be mounted subsequently because transporting skis with a mounted ski binding is not possible or economical due to the increased risk of damage to the running surfaces and the larger shipping volume required. Also after mounting the binding there is an increased risk of damage, due to the raised arrangement on the ski, particularly to the locking mechanism (spring bow).

In the patent designated as DD-PS No. 136 335 (=DE-OS No. 2 815 167=AT-PS No. 352 601) a cross-country ski binding is described which considerably facilitates the stepping in and stepping out compared to the conventional jaw designs with elastic bows and holding pins. There the sole extension is fixed by way of snap locking. However, this new-type of cross-country ski binding, has the same shortcomings as those mentioned in the foregoing.

SUMMARY OF THE INVENTION

Therefore, the present invention is based on the task of creating a touring and/or cross-country ski with a binding for holding in a positive- and friction-locked manner an anterior tongue shaped extension of the sole of a ski shoe, which when the ski binding is mounted requires very little shipping space and which can be shipped without the risk of damage(s) on account of the mounted binding.

This problem is solved in a surprisingly simple manner. The invention comprises a cross-country ski with a binding for holding in a positively and frictionally locking manner an anterior tongue-shaped extension of the sole of a ski shoe characterized in that the binding is arranged in lowered position in the ski body preferably in such a manner that no parts of the binding protrude above the ski surface and that the binding includes a recess in the ski body extending in the longitudinal direction of the ski, in which the sole extension of the ski shoe can be fixed and sole latching means to secure releasably the attachment of the sole extension in the binding.

According to the invention the ski binding is provided in the ski body in lowered or integrated position. Thereby it is possible that the ski requires only a minimum space for shipment. In addition, there is no risk any longer of damage due to a binding which is mounted for shipment.

Preferably all parts used for fixing the sole extension or the ski shoe are completely below the ski deck area. There are no longer any protruding parts which would make the shipment of the skis difficult, and no increased frictional resistance is encountered when the skis are used, that is during cross-country skiing.

Also, with the ski designed according to the invention it is no longer required that the binding be mounted by a specialist subsequently. Due to the design according to the invention the ski manufacturer is enabled to make and supply the ski and the ski binding in its complete form, that is as a compact unit.

To obtain a positive- and friction-locked attachment of the sole extension of a ski shoe in the binding an abutment for the sole extension and a latching device is provided for the recess, which acts together with complementing elements provided at the sole extension. The abutment is designed in such a manner that the sole extension grips from below or above same or reaches it in the rear with its end part introduced into the recess.

With a preferred manner of application of the design the abutment which interacts with the sole extension, is formed by a crosspiece spanning over the recess. In such case the abutment defines the bending axis of the sole extension when the heel is lifted (compare for example German Offenlegungsschrift DE-OS No. 2 754 005).

Also a protrusion projecting into the recess can serve as abutment, this protrusion is preferably located—seen in the longitudinal direction of the ski—at the rear crosswall of the recess, so that it can be reached by correspondingly designed end of the sole extension. In connection with a provided holding element this protrusion defines the bending axis of the sole extension when the heel is lifted.

Instead of the mentioned sole protrusion it is also possible to provide protrusions which project into the recess at both of its longitudinal sides under which the front part or also laterally protruding lugs of the sole extension can be slid. When the heel is lifted, the bending axis of the sole extension is formed by the two laterally protruding lugs of the sole extension, in the last mentioned manner of application.

The latching device provided for the binding includes latching devices provided in the recess, so-called binding latching means, and sole latching means assigned to same or supplementing same. These latching elements act together in such a manner that a mutual hook-up-action is obtained. Preferably, the sole latching elements are formed by protrusions projecting upward, and the binding latch elements are formed by protrusions projecting downward, or vice versa; they can be hooked together. The sole latching elements may also be protrusions laterally projecting beyond the sole extension, which can be snapped into the corresponding recesses or deepenings at the sidewalls of the binding recess, or vice versa. The protrusions are designed elastically or they are preloaded by a resilient element.

With a further structural development of the invention the recess is a trough-shaped deepening with a somewhat trapezoidal-shaped cross-section in the longitudinal direction of the ski and an approximately rectangular cross-section transverse to the longitudinal direction of the ski. In the design of the abutment as a crosspiece same is then approximately at the level of the rear end of the flat sole of the recess. The rear slanting surface of the recess designed in such a manner facilitates the introduction of the sole extension into the recess and underneath the abutment or through the crosspiece, in inclined fashion from above. The skier or the cross-country skier can thus "enter" the binding without difficulty. Snow, which has accidentally collected in the recess is pushed out from same by the sole extension via the inclined front surface of the recess.

With a preferred design of the invention the latching device includes a resiliently mounted protrusion approximately vertical to the ski deck area, which can be gripped by a correspondingly inserted protrusion at the free front end of the sole extension. With a sufficiently deep introduction of the sole extension into the recess and underneath and through the abutment designed as a crosspiece, the two protrusions of the latch device and of the sole extension are engaged or hooked together.

Preferably, the protrusion of the latching device is provided at the bottom side of an operational element which is resiliently mounted and rotatable around an axis extending in an approximately transverse manner to the longitudinal direction of the ski; preferably, it is adjusted to its shape. This type of latching device has a particularly simple structure which can be handled with ease. To unlock the latching device a notch for the tip of the ski pole is provided at the upper side of the operational element, at the end not facing the protrusion, in such a manner that by applying pressure on the tip of the ski pole and thus on the notch, the operational element can be brought or tilted into its unlocking or releasing position. Thus the rotary axis of the operational element is located between the notch and the latch protrusion.

A particularly simple design of the latching device is characterized in that the operational element is designed as a level plate and in that, at both sides of the recess, it is fastened to the ski body via two spring-leaf-like flaps, which define the rotary axis of the operational element. At its bottom side the operational plate features the latching protrusion at the end facing the abutment designed as a crosspiece, and at its upper side the notch for the tip of the ski pole at the front end not facing the abutment designed as a crosspiece. The operational plate is provided in such a manner that it forms part of the ski deck area. It can be dimensioned in such a manner that it releases a front opening slot of the recess, through which snow which may possibly have accumulated, can be pushed out from the recess through the sole extension introduced from behind.

It is also conceivable to dimension the operational plate in such a manner that with an engaged sole extension the entire recess is covered or covered over, so that snow cannot penetrate into the recess at all. This dimensioning of the operational plate is primarily meaningful with the form of application according to claim 6, where a protrusion projecting into the recess is serving as an abutment, which protrusion is located at the rear cross rim or at the rear sidewall of the recess. Beyond this the operational plate under this form of application rather serves as a holding element or support than as a latching element.

In accordance with another embodiment of the invention the latching device provided for the recess or the binding may include at least one tenon provided in the recess, which acts together with a corresponding slot or cut in the sole extension, wherein the tenon may be externally actuated to overcome a resilient element into a position in which it releases the sole extension.

Finally, also a clamping device can be provided as a means to fix the sole extension in the recess, which holds the sole extension in the recess essentially in frictionally locked manner.

Also, the arrangement of a conventional cross-country ski binding with a spring bow in the recess is conceivable as long as it is made sure according to the invention, that the holding or fixing means do not project above the ski deck area.

In terms of manufacturing techniques it is of particular advantage if the recess is formed by a component of plastic, alloy steel or similar which can be inserted into the ski body. This component is connected with the ski body preferably by glueing, foaming-in-place and/or screwing together.

If both the abutment and the latching device are an integral part of the component forming the recess, the binding which is made in a separate operation, can be inserted as a whole entity into a corresponding cavity in the ski body, and be connected with same, for example glued together.

In the manufacture of the component or insertable plastic part same is preferably designed as a one-piece component (injection moulded part).

To increase the lateral guidance of the ski shoe, the rear slanting surface of the recess is provided with at least one guide groove or guide cam extending in the longitudinal direction of the ski, which can be continued outside the recess toward the back or toward the end of the ski, and which acts together with a corresponding guide cam or groove at the bottom side of the outsole or the front sole extension of same. The guide groove or guide cam is thus equally an integral part of the binding according to the invention.

Moreover, the width of the tongue-shaped front sole extension corresponds approximately to the clear width of the recess in the ski body, whereby also a certain lateral guidance of the ski shoe is ensured with regard to the ski.

With a sole extension at the outsole level the shoe inserted into the binding extends, with a sloping surface, in the back of the integrated ski binding, upward in oblique manner when in unloaded condition. This leads to the surprising advantage that after the pushoff, when the ski is lifted in the back, the optimum angle is obtained between the shoe and the ski on the one hand, and between the ski and the running plane on the other.

According to the invention the heel of the cross-country shoe can be designed a little higher than ordinarily, in order to diminish the distance between the bottom side of the outsole and the ski deck in the heel area and to impart a certain forward lean of the body to the skier when going on a downhill run. With the latter solution the running surface of the ski shoe can be wedge-shaped from the front toward the back in the cross-section.

According to the invention the sole extension may, however, also be somewhat bent downward, in order to additionally facilitate the introduction into the recess with the inclined surface at the back.

To further increase the lateral guidance of the ski shoe a flat trough joins the slanting surface of the recess in the rear, the width of which is somewhat larger than the width of the sole extension and the depth of which is somewhat smaller than the thickness of the sole extension. This trough serves as a partial receiving part for the sole extension and thus as a raised lateral guide also when the heel is lifted.

The provision of a flat trough is advantageous particularly with the manner of application where the abutment is formed by a latching protrusion provided at the back cross rim of the recess, because with this manner of execution only a short introduction of the sole extension is effected into the recess. The lateral stabilizing effect of the sidewalls of the recess is therefore relatively small with this type of application. The lateral guidance is very essentially provided through the mentioned guide trough directly joining the back cross rim of the recess.

To obtain a better anchoring of the integral component mentioned in the foregoing with the recess, the abutment and possible latching device in the ski body, same is provided preferably at the bottom side with a lug-shaped projection extending in the longitudinal direction of the ski toward the back and/or a luglike projection extending in the longitudinal direction of the ski toward the front, which represent or represents a kind of barb.

DESCRIPTION OF THE DRAWINGS

Following is an explanation of preferred embodiments of the invention, as shown in the attached drawing wherein.

DESCRIPTION OF THE EMBODIMENTS

Figure 1:
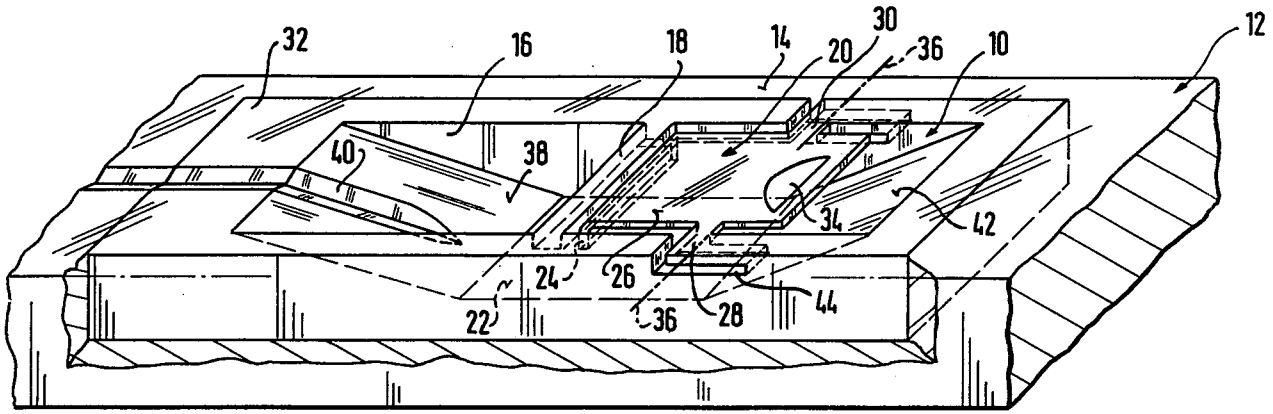
FIG. 1 shows a section of a ski body with an integrated binding in perspective presentation according to the invention.

FIG. 1 shows a portion of a ski body 12 in perspective view, in which the binding 10 is located. The ski binding 10 is designed as a uniform component 32, preferably of plastic material, and arranged in the ski body 12 in lowered position. The upper side of the ski binding 10 ends flush with the ski deck area 14.

The component 32 includes a recess 16, the cross section of which is trapezoidal in the longitudinal direction of the ski and rectangular in transverse direction of the ski, and into which a correspondingly dimensioned anterior tongue-shaped extension of the sole of the ski shoe not shown, can be introduced. The sole extension grips from underneath an abutment in the form of a crosspiece 18 spanning over the recess 16, which at the same time defines the bending axis of the sole extension. The crosspiece 18 extends approximately at the level of the ski deck area 14.

At the side of the cross-piece 18 facing the tip of the ski a latch device 20 is provided in the recess 16, which includes an operational plate 26 seated resiliently and rotatable around an axis 36 which extends transverse to the longitudinal direction of the ski, at the back end of which a latch projection 24 is located which extends downward. The latch projection 24 is adapted to the shape of the operational plate 26 at the bottom side. It acts together with a corresponding projection pointing upward, at the free front end of the sole extension which can be introduced into the recess 16, in interlocking manner. The latch projection 24 is preferably bent a little toward the front, whereas the complementary latch projection pointing upward is slightly bent toward the rear at the upper side of the sole extension of the ski shoe which is not shown. Thereby a proper hooking up of the mentioned latch projections and thus a secure fixing of the ski shoe to the ski is ensured.

The mounting of the operational plate 26 in a resilient and partially rotatable member at the ski body, or in the present case at the component 32 is effected in each case via two leaf-spring-like flaps 28, 30 provided at both sides of the recess 16, which at the same time define the rotary axis 36 of the operational plate 26. The operational plate 26 as well as the leaf-spring-like flaps 28, 30 are integral parts of the component 32 in the present embodiment. The same applies to the crosspiece 18. Thus the entire binding 10 is a one-piece structural or insertable part in the embodiment shown.

The leaf-spring-like flaps 28,30 are obtained by corresponding L-shaped indentations in the lateral walls of the component 32 as the enclosed drawing will clearly show.

However, it is equally possible that the attachment plate 26 is fastened only via connecting pieces which are resilient and rotatable and extend toward the rotary axis or bending line 36, to the two lateral walls of the component 32 or to the ski body 12.

A notch 34 is provided for the tip of the ski pole at the front end of the operational plate 26 or at the end facing the tip of the skis, that is at the upper side, in such a manner that by applying pressure on the notch the operational plate is tiltable around the axis 36 into its unlocking or releasing position. By pressure on the notch 34 the latch projection 24 is raised so that the matching projection at the upper side of the sole extension not shown is released.

In the embodiment illustrated, the bottom of the recess 16 is defined by an oblique surface 38 in the back, a front inclined surface 42 and a sole 22. The inclined surface 38 in the back is provided with a guide groove 40 extending in the longitudinal direction of the ski, which is to some extent continued outside the recess 16 toward the back, and into which a matching guide cam engages at the bottom side of the outsole as well as the front sole extension of the ski shoe not shown.

The operational plate 26 mounted in a resilient and partially rotatable manner at the component 32 or the ski body 12 is dimensioned in such a manner that a front opening slot is kept free to the recess 16, through which snow which may be in the recess 16, can be pushed out, if through the rear entry port of the recess 16 the sole extension is pushed into same and underneath through the crosspiece 18.

The component 32 is preferably glued into the ski body 12. However, it may also be connected to the ski body 12 in separable manner by means of conventional screw connections. The latter solution offers the advantage that the binding 10 can be easily exchanged when the bending component of the operational plate 26 becomes fatigued. In the area of the binding 10 the ski body suffers a certain weakening effect on account of the recess 16 or the installation of the component 32. This weakening can be offset without difficulty by a pertinent reinforcement of the side jaws and of the lower runners of the ski body in this area. A glass fibre reinforcement sheathing is preferred. However, also reinforcements with spring steel are conceivable.

As was explained at the beginning, naturally, the width of the sole extension which can be introduced into the recess 16 corresponds approximately to the clear width of the recess 16, whereby a good lateral guidance of the ski shoe can be obtained independently of the guide groove 40. The thickness of the sole extension is dimensioned in such a manner that it can be pushed through with only little play under the crosspiece 18 with the projection which points upward and acts together with the projection 24 of the latch device 20.

The surface facing the end of the ski, of the latch projection 24 pointing downwards is preferably bevelled downward and toward the front. In analogous manner the front surface of the latch projection adapted to the shape of the upper side of the sole extension is bevelled toward the rear at the top. In this manner the deflection of the latch projection 24 or the operational plate 26 upward when the sole extension is introduced into the binding 10, is facilitated. The other way round the latching is not impaired thereby on account of the engagement.

Instead of the described latch device also laterally acting latching means can be provided which engage into the matching lateral notches of the sole extension and can be brought into an unlocking position again against the action of a resilient element. Also a reverse arrangement of the mentioned latching means is conceivable.

The resilient elements of the latching means can be positioned here in such a manner that, when a predetermined traction force on the sole extension is exceeded, the same is released automatically thereby acting as a safety binding.

In the embodiments shown in FIGS. 2 and 3, parts which have been described in connection with FIG. 1, are identified by the same reference figures. Therefore, a pertinent description is not required.

Figure 2:
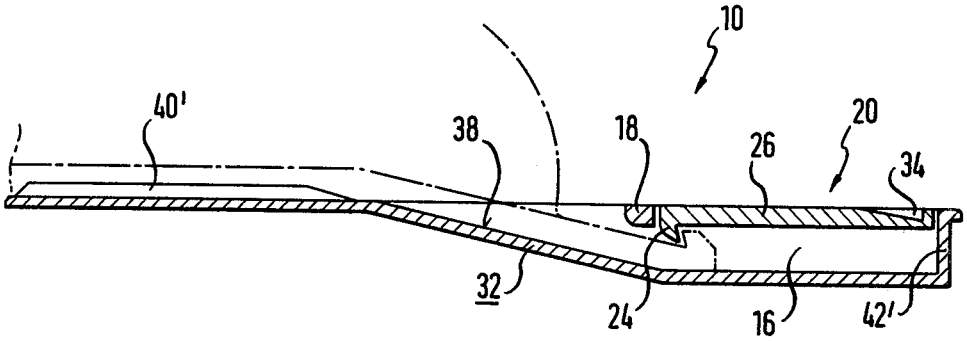
FIG. 2 shows a form of application of the binding designed according to the invention, in the longitudinal section, which is slightly modified from the manner of execution according to FIG. 1.
Figure 3:
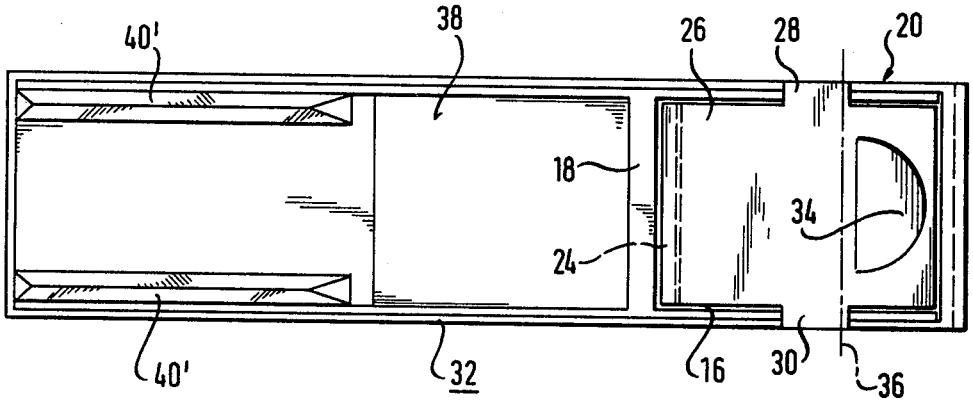
FIG. 3 shows the binding according to FIG. 2 as a plan view.

The embodiment according to FIGS. 2 and 3 distinguishes itself from that according to FIG. 1 essentially only by the fact that the front slanted surface 42 of the recess 16 is replaced by an upright or front sidewall 42' or one which extends vertically to the ski deck area. The operational plate 26 is also dimensioned in such a manner that it provides complete cover for the recess 16 in the area between the crosspiece 18 and the front sidewall 42'. Finally no guide grooves are provided corresponding to the guide groove 40 with the binding according to FIGS. 2 and 3, but two raised guide cams or ribs 40' are provided instead.

In the embodiment according to FIGS. 2 and 3 it is ensured in particular that no snow can penetrate into the recess with the outsole locked. The embodiment according to FIGS. 4 and 5 distinguishes itself from the embodiment of FIGS. 1 to 3 essentially by the fact the the crosspiece 18 serving as an abutment is replaced by a projection 18' protruding into the recess 16, which is provided at the transverse rim of the recess 16. This projection 18' can be reached from behind by a correspondingly designed hook-shaped end 47 of the sole extension 46 (shown by a dotted line), as presented schematically in FIG. 4. The capture of the sole extension or the hook-shaped end of same in the recess 16 is effected by a holding element 24' which is adapted to the shape of the end of a resiliently and rotatably mounted operational plate 26' facing the sole extension in accordance with the operational plate 26 described in the foregoing. The holding element 24' is thus mounted in a resilient and partially rotatable manner in the insert part 32 or ski body via the operational plate 26'.

Figure 4:
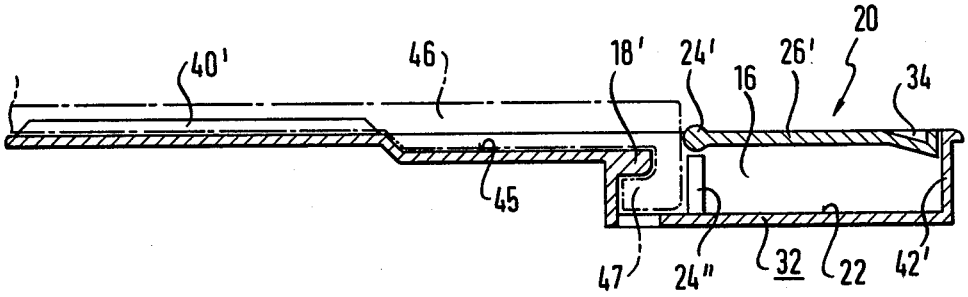
FIG. 4 shows a further manner of application of the binding according to the invention, in a longitudinal section.
Figure 5:
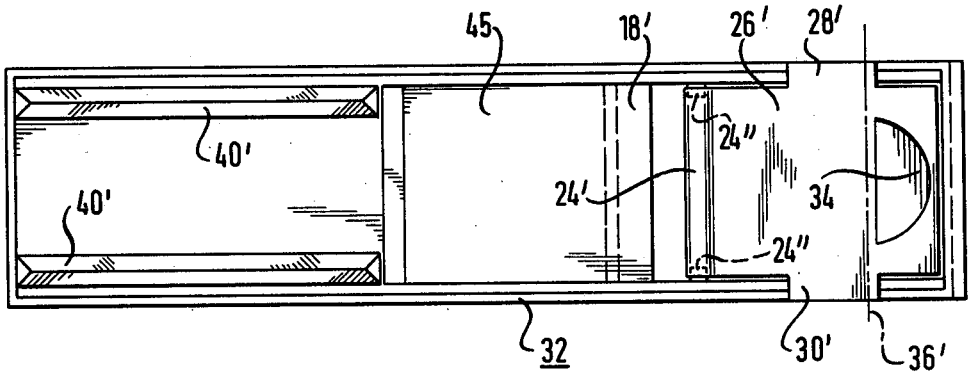
FIG. 5 shows the binding according to FIG. 4 as a plan view.

In the embodiment according to FIGS. 4 and 5 the holding element 24' is designed as a collar whereby a certain unrolling of the hook-shaped end 47 of the sole extension 46 is ensured when the heel is lifted over the collar. The operational element 26' or the holding element 24' is supported via a support 24'' at the sole 22 of the recess 16 in order to avoid the holding element 24' or the end of the operational plate 26' facing the sole extension being pressed into the recess 16 when the heel is lifted, by the sole extension or the end of same. As can be seen from FIG. 5, the support 24'' is formed by two upright ledges fitted to the shape of the sidewalls of the recess 16. The resilient and rotatable plate 26' is mounted in the same way as with the operational element 26 described in the foregoing, via leafspring-like flaps 28', 30'. These flaps also define the rotary axis 36' of the operational plate 26' (FIG. 5).

By applying pressure on the notch 34 the holding element 24' is raised and the hook-shaped end 47 of the sole extension 46 is set free.

The embodiment of FIGS. 4 and 5 features still another peculiarity, namely a flat trough in addition to the projection 18' serving as an abutment. The width of this flat trough 45 is slightly larger than the width of the sole extension 46. The depth of the flat trough 45 is somewhat smaller than the thickness of the sole extension 46. Moreover, as FIG. 4 allows us to see, the thickness of the sole extension 46 is larger in the area of the trough 45 than in the other areas. A raised lateral guidance is obtained through the trough 45, that is even with the lifted heel. The trough 45 is of great significance particularly with the manner of application according to FIGS. 4 and 5, since with this manner of application the lateral walls of the recess 16 ensure much less lateral guidance than for example that found in the embodiments of FIGS. 1 to 3.

The parts described in connection with FIGS. 4 and 5 are identified by the same reference numbers as are similar parts in FIGS. 1 to 3.

Figure 6:
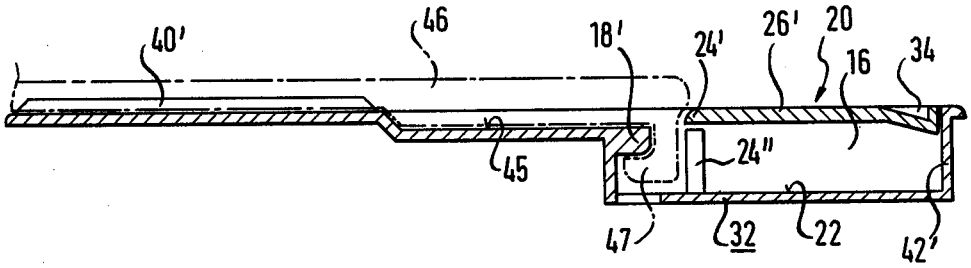
FIG. 6 shows a manner of execution of the binding according to the invention in a longitudinal section, which is slightly modified from the manner of execution according to FIGS. 4 and 5.

The embodiment of FIG. 6 distinguishes itself from the one according to FIGS. 4 and 5 only by an alternate design of the holding element 24' and the complementary design of the side of the sole extension 46 facing this holding element. In the embodiment of FIG. 4 the holding element 24' is formed by a slanting surface inclined upwardly towards the front. In analogous manner the facing side of the free end of the sole extension 46 is bevelled. In this way it is ensured that when the heel is lifted, the holding element 24' is pressed against the support-ledges 24'' and the hook-shaped end 47 of the sole extension 46 is not set free.

Figure 7:
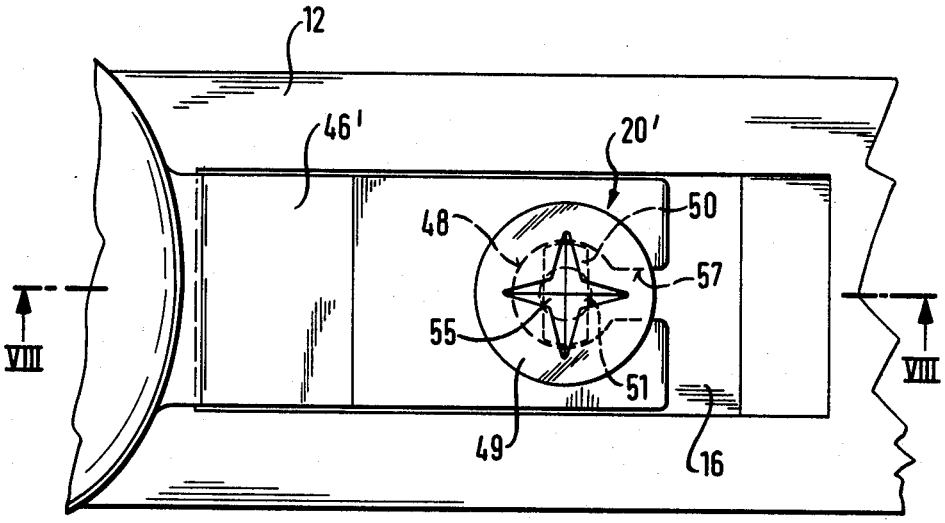
FIG. 7 shows a fifth manner of application of the binding according to the invention, as a plan view.
Figure 8:
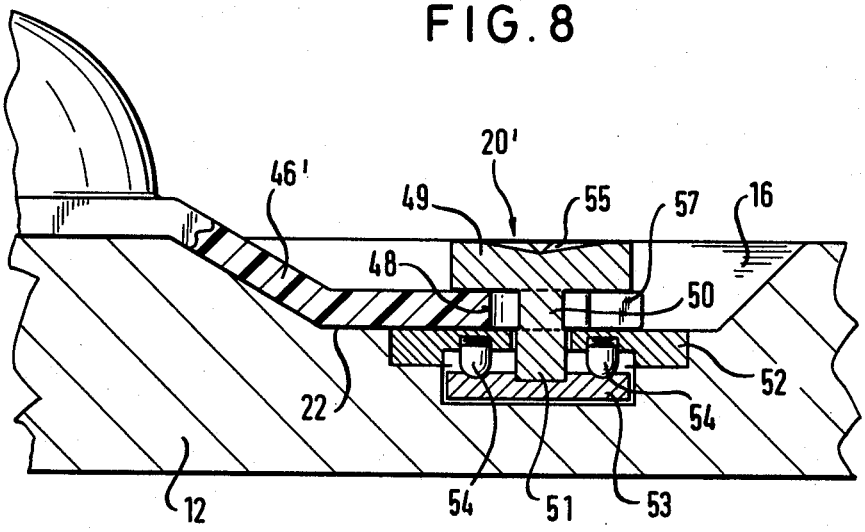
FIG. 8 shows the binding according to FIG. 7 as a section along line VIII—VIII in FIG. 7.

In the embodiment of FIGS. 7 and 8 the sole extension is flexed downwardly or adapted to the trapezium-shaped cross-section of the recess 16 in the longitudinal direction of the ski. In addition, the sole extension 46' features a longitudinal slot 57 the inner end of which is formed by an approximately circular-shaped opening 48. In place of a resiliently acting latch or snap device a positive lock 20' is provided to fix the sole extension 46' in the recess 16. The lock 20' includes a holding element 49 (holding disk) rotatable in the recess around a vertical axis, under which the sole extension 46' can be slid. A locking part 50 is formed on the underside of the holding disk 49, the width of which corresponds approximately to the width of the longitudinal slot 57 and the length of which matches approximately the diameter of the opening 48. A rotary axis 51 is formed on locking part 50, which is mounted in pivoted manner in the sole 22 or a corresponding sole bearing 52. The holding disk 49 is fixed in the sole bearing 52 via a holding disk 53 fastened to the free end of the axis 51, which acts together with spring-loaded arresting cam 54. The interaction of the holding disk 53 with the arresting cam 54 is effected in such a manner that the flat interlocking part 50 is arrested either in the longitudinal direction of the ski or transversally thereto. Here the arresting of the flat locking part 50 in the transversal direction to the ski is particularly important, in order to prevent an unintentional slipping out of the sole extension from the recess 16 during the cross-country runs, that is during the time of changing load. To operate the lock 20' an approximately crosslike deepening is provided at the upper side of the holding disk 49, into which, for example, a correspondingly designed ski tip can be inserted. The crosslike deepening is marked with reference figure 55 in the FIGS. 7 and 8. However, it is just as well possible to provide a simple slot similar to the slot in the head of a screw.

It is preferred that the diameter of the holding disk 49 is only slightly smaller than the width of the recess 16, in order to ensure sufficient fixation of the sole extension in the recess 16. The outer circumference of the holding disk 49 does not need to be round like a circle but it may also have an oval shape.

As with the manners of application described in the foregoing the recess 16 is preferably a one-piece component, where the described lock 20' and the seating of same are attached in the ski body separate from this component. However, it is also conceivable that the recess and the lock device and mounting of same are designed as a part to be inserted and that same can be installed into the ski body as an entity.

A very simple solution is characterized in that a spring-loaded push button protruding upward is provided at the sole extension, which can be engaged into an opening slot (bore) in the crosspiece where the upper side of the push button shows a preferably trough-shaped deepening for the engagement of the tip of the ski pole. The upper side of the push button is preferably slightly inclined upward from the front to the back, in order to facilitate the introduction of the sole extension into the recess or under the crosspiece.

All features disclosed in the documents are claimed as essential for the invention, as far as they are new compared with the stage of the art individually or in combination.

We claim:

1. A cross-country ski which comprises:

(a) a ski body having a substantially planar top surface, the ski body characterized by a cavity portion therein;

(b) a binding for holding, in a positive and locking manner, an anterior, forwardly extending extension of the sole of a ski boot, the binding arranged in said cavity portion, so that the binding is at or below said planar top surface, the binding characterized by a recess formed to receive said extension of the sole, and which recess extends in the longitudinal direction of the ski; and (c) a sole-extension latching means for releasably securing said extension of the sole within the said recess and which forms a cover for at least part of said recess.

2. The ski of claim 1 wherein the said recess is substantially trapezoidal in the longitudinal direction of the ski and is substantially rectangular in the transverse direction of the ski.

3. The ski of claim 1 wherein said recess has a front wall in the longitudinal direction of the ski and toward the ski tip, which front wall extends in a substantially vertical direction with respect to said top planar surface.

4. The ski of claim 1 wherein the binding and sole-extension latching means comprises an integral component which is inserted into the cavity portion of the ski, and means to secure the said component in the cavity portion.

5. The ski of claim 1 wherein the sole-extension latching means comprises:

(a) a crosspiece element extending transversely across the said recess, to define the bending axis of the extension of the sole;

(b) a rotatable plate element which is rotatable about an axis of rotation which extends transversely to the longitudinal direction of the ski, the plate element rotatable between a sole-latching position and a sole-releasing position; and (c) projection means on one end of the plate element, to engage in a latching relationship with the extension of the sole in said recess, to plate the plate element in a latching position with said extension of the sole.

6. The ski of claim 5 which includes releasing means on the other end of the rotatable plate element, so that, on the application of pressure, the plate element moves to the sole-releasing position.

7. The ski of claim 6 wherein the releasing means comprises a notch area on the upper surface of the other end of the rotatable plate element facing the tip of the ski, so that, on the application of downward pressure on the notch area, the plate element rotatably moves to the sole-releasing position.

8. The ski of claim 5 wherein the rotatable plate element is positioned at about the planar top surface, so as to provide openings in the said recess at the one rear end of the recess for the insertion of the extension of the sole, and at the front end of the recess for the removal of snow from the recess.

9. The ski of claim 5 which includes resilient means to bias the rotatable plate element into a sole-latching position.

10. The ski of claim 9 wherein the resilient means comprises leaf spring-like flap elements secured to the plate element and the lateral sides of the recess, which flap elements define the axis of rotation of the plate element.

11. The ski of claim 5 wherein the one end of the plate element includes a downwardly extending projection, and the extension of the sole includes an upwardly extending projection for cooperative engagement with the downwardly extending projection, to secure the extension of the sole in a secure, latching position.

12. The ski of claim 1 which includes lateral-guidance means on said top planar surface and rearward of the said recess, to provide lateral guidance to the ski shoe.

13. The ski of claim 12 wherein the lateral-guidance means includes a longitudinally extending guide groove extending on the rearward face surface of the recess, the bottom sole of the ski shoe adapted to have a corresponding guide cam which fits into said groove, to provide lateral guidance to the ski shoe.

14. The ski of claim 1 wherein the sole-extension latching means comprises:

(a) a projection element which extends from the rear cross wall of the recess in the longitudinal direction of the ski into the recess;

(b) a rotatable plate element which is rotatable about an axis of rotation which extends transversely to the longitudinal direction of the ski, the said plate element rotatable between a sole-latching position and a sole-releasing position;

(c) a holding element on the one end of the said plate element toward the projection element; and (d) resilient means to bias the rotatable plate element in the sole-latching position, the sole extension of the ski shoe adapted to have, at its front end, a downward, hook-like extension which fits about the projection element, to place the ski shoe in the sole-latching position.

15. The ski of claim 14 which includes a support element to support the said one end of said plate element, which support element comprises two upright ledges fitted to the side walls of the recess and below the one end of the said plate element.

16. The ski of claim 14 wherein the said plate element is generally at the plane of the top planar surface and extends over the forward end of the said recess facing the ski tip, to prevent snow from entering the recess.

17. The ski of claim 14 wherein said recess is characterized by a flat trough shape, wherein the rearward area of the recess has a depth smaller than the thickness of the sole extension, and the forward area of the recess has a depth greater than the thickness of the sole extension.

18. A cross-country ski having a substantially planar top surface with a binding for holding in a positively and frictionally locking manner an anterior tongue-shaped extension of the sole of a ski shoe, said sole extending forward from the front of the ski shoe:

(a) which binding is arranged in a cavity portion in the ski in such a manner that the binding is at or below said planar top surface of the ski, the binding including a recess in the ski body extending in a longitudinal direction of the ski and formed to receive said extension of the sole;

(b) which binding includes an abutment means of a cross piece extending laterally over the recess, to define the bending axis of the sole extension; and (c) which binding includes a sole-latching means for securing releasably said sole extension comprising (i) a plate extending laterally across a portion of the upper surface of the recess and toward the front end thereof and mounted for rotation about an axis extending laterally across the recess, the plate being located generally at or below said planar top surface of the ski, so that in use the plate rotates movable between a sole-latching and-releasing position, (ii) resilient means to bias the plate to a sole-latching position, (iii) projection means at one longitudinal end of the plate, to engage in a sole-latching relationship with said extension of the sole, to retain the sole in a latched position, and (iv) sole-releasing means at the other longitudinal end of the plate, to release said sole extension by rotating the plate.

* * * * *